US005211375A

United States Patent [19]

Wang

[11] Patent Number: 5,211,375

[45] Date of Patent: May 18, 1993

[54] ELECTRIC HYDRAULIC JACK/AIR PUMP

[76] Inventor: Ta C. Wang, No. 269, Sec. 2, Anho Rd., Tainan, Taiwan

[21] Appl. No.: 888,512

[22] Filed: May 26, 1992

[51] Int. Cl.[5] ..... B66F 3/24

[52] U.S. Cl. ..... 254/93 M; 254/1; 254/124

[58] Field of Search ..... 254/93 M, 93 R, 8 B, 254/2 B, 1, 89 M, 418, 423, DIG. 2, 129; 7/100; 74/15.6, 15.63; 60/435, 486, 400

[56] References Cited

U.S. PATENT DOCUMENTS

| | | | |
|---|---|---|---|
| 1,983,444 | 12/1934 | Dry | 254/423 |
| 2,458,590 | 1/1949 | Harris et al. | 254/DIG. 2 |
| 3,972,509 | 8/1976 | Cancilla | 254/93 M |
| 4,653,727 | 3/1987 | Chang et al. | 254/DIG. 2 |
| 4,678,162 | 7/1987 | Yang | 254/93 M |
| 4,706,937 | 11/1987 | Clung | 254/93 M |
| 4,741,511 | 5/1988 | Yang | 254/93 M |
| 4,746,097 | 5/1988 | Chung et al. | 254/93 M |
| 4,775,132 | 10/1988 | Yang | 254/93 M |
| 4,925,158 | 5/1990 | Yang | 254/93 M |

*Primary Examiner*—Robert C. Watson
*Attorney, Agent, or Firm*—Louis Weinstein

[57] ABSTRACT

An electric hydraulic jack/air pump includes a base on which a hydraulic assembly, an air pump assembly, and a transmission assembly are mounted. The hydraulic jack assembly includes a first cylinder for effecting a lifting function upon reciprocating motion of a first piston. The air pump assembly includes a second cylinder for effecting an air-filling function upon reciprocating motion of a second piston. The transmission assembly includes a motor electrically connectable to a power source, a shaft driven by the motor, a wheel eccentrically mounted on the shaft, and a ring securely mounted around the wheel. The first and second pistons are respectively connected to the ring to effect the lifting and air-filling functions.

4 Claims, 7 Drawing Sheets

ELECTRIC HYDRAULIC JACK/AIR PUMP

BACKGROUND OF THE INVENTION

The present invention relates to improved electrical hydraulic jack/air pumps and, more particularly, to the transmission assembly thereof.

Electrical hydraulic jack/air pumps are common and useful vehicle accessories. However, such a device often vibrates notably during operation due to a bad transmission which also results in an inefficient performance.

Therefore, there has been a long and unfulfilled need for an electrical hydraulic jack/air pump with an improved transmission assembly to mitigate the above-mentioned problem.

SUMMARY OF THE INVENTION

According to one aspect of the present invention, an electrical hydraulic jack/air pump has a base on which a hydraulic assembly, an air pump assembly, and a transmission assembly are mounted.

The structure and operation of the hydraulic jack assembly and the air pump assembly are the same as conventional hydraulic jack/air pumps. The present invention is characterized in the transmission assembly which includes a motor electrically connectable to a power source, a shaft driven by the motor, a wheel eccentrically mounted on the shaft, and a ring securely mounted around the wheel. A first piston of the hydraulic jack is connected to a first seat on the ring, and a second piston of the air pump is connected to a second seat on the wheel, thereby allowing reciprocating motion of the first and second pistons in associated first and second cylinders for effecting the lifting function and/or the air-filling function.

According to another aspect of the present invention, the transmission assembly includes a motor with an output gear through which power is transmitted to a crankshaft on which first and second cranks are mounted. First and second piston assemblies of the hydraulic jack and air pump are respectively connected to the first and second cranks, thereby allowing reciprocating motion of the pistons in associated cylinders for effecting the lifting and/or air-filling functions.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
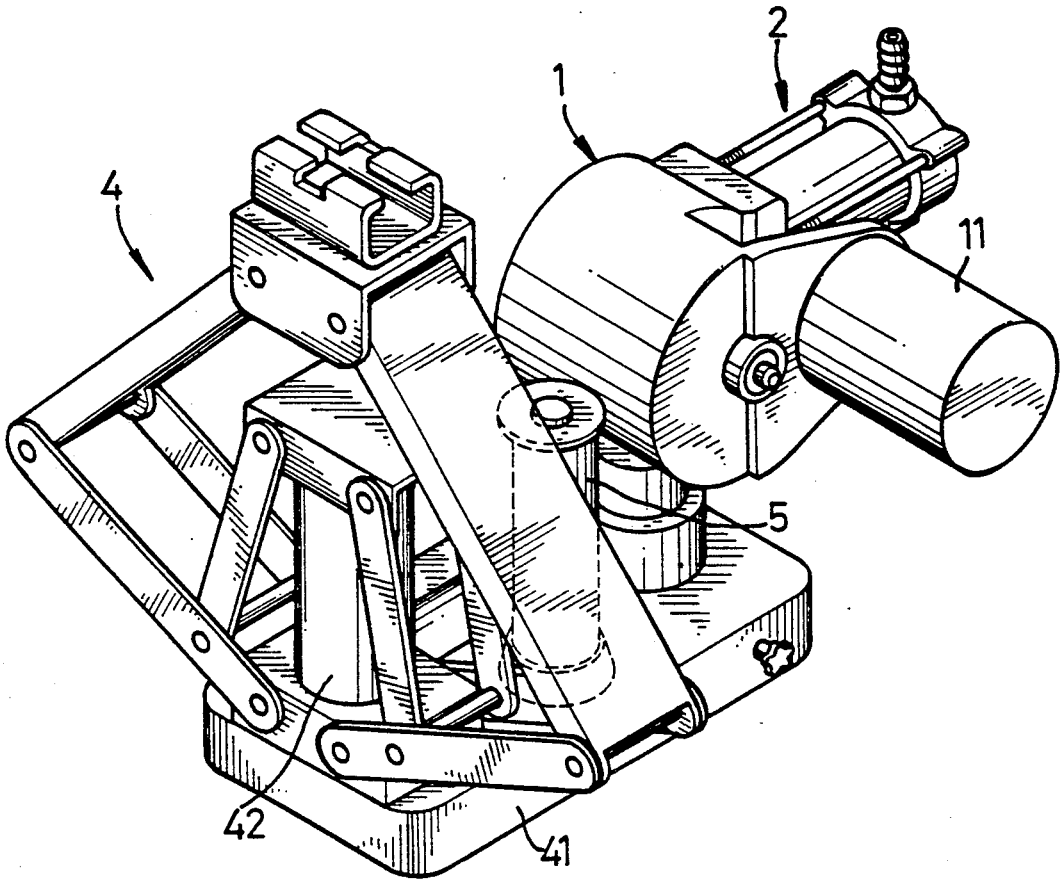
FIG. 1 is a perspective view of an electrical hydraulic jack/air pump in accordance with the present invention.
Figure 2:
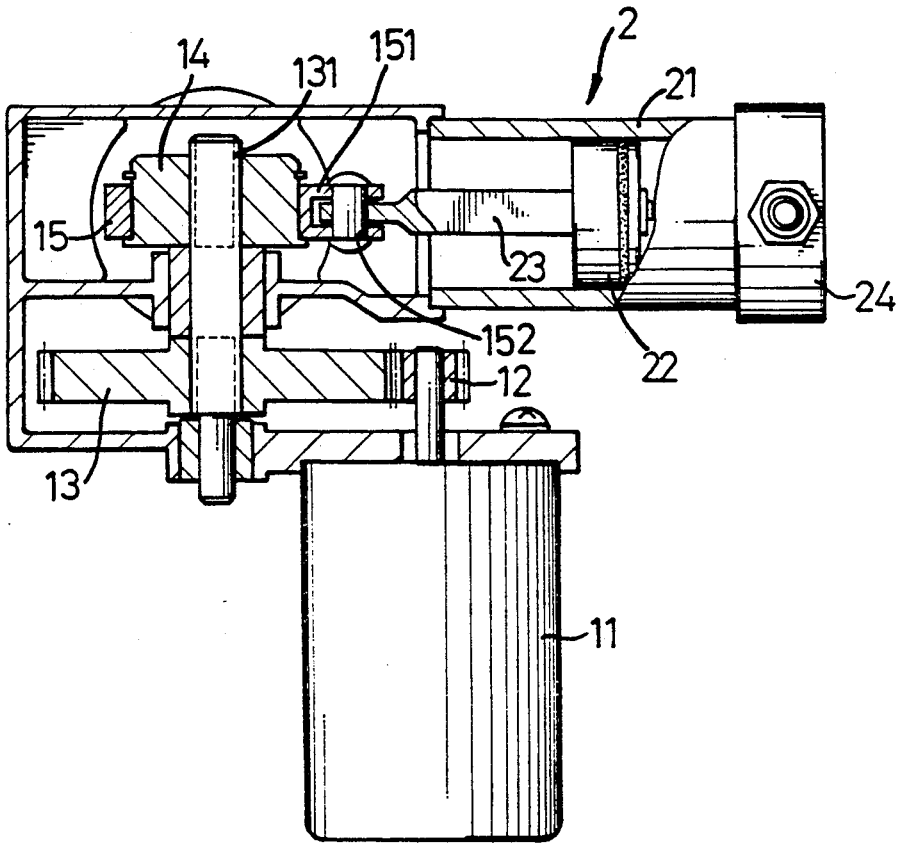
FIG. 2 is a cross-sectional view from top of the electrical hydraulic jack/air pump.
Figure 3:
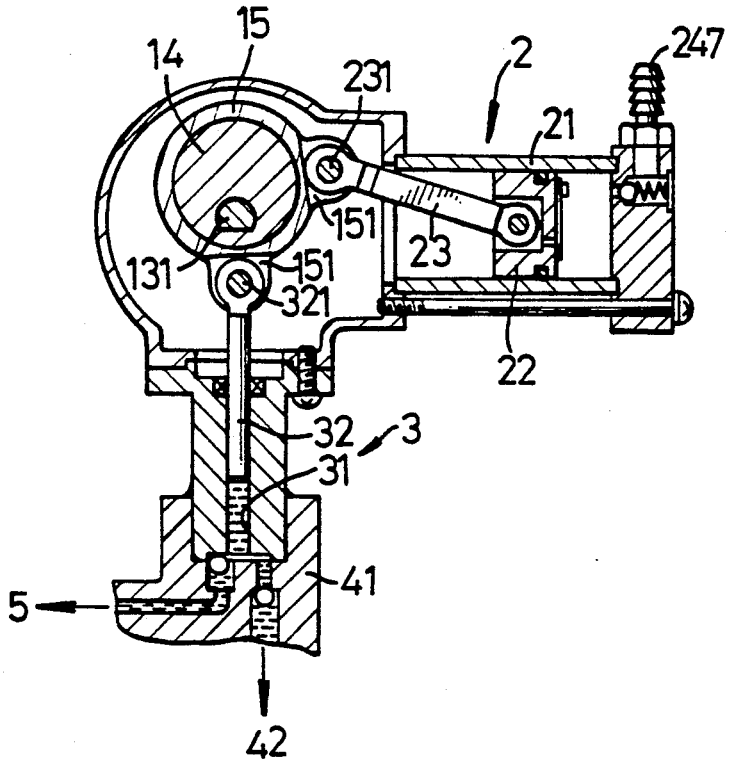
FIG. 3 is a cross-sectional view showing the structure of the transmission assembly of the electrical hydraulic jack/air pump wherein the hydraulic jack is in a suction stroke.

Referring to FIGS. 1 through 3, an electrical hydraulic 15 jack/air pump in accordance with the present invention generally comprises a base 41 on which a hydraulic jack assembly 4, an air pump assembly 2, and a transmission assembly 1 are mounted. The hydraulic jack assembly 4 includes a first cylinder 3 communicating with an oil tank 5 and a hydraulic oil chamber 42 for effecting a lifting function upon reciprocating motion of a first piston 32 in an oil chamber 31 defined by the first cylinder 3, which is conventional therefore further explanation is not required.

The air pump assembly 2 includes a second cylinder 21 communicating with a nozzle 247 for effecting an air-filling function upon reciprocating motion of a second piston 22 in an air chamber 25 defined by the second cylinder 21, which is also conventional therefore further explanation is not required.

The present invention is characterized in the transmission assembly 1 which includes a driving means, such as a motor 11 electrically connectable to a power source, such as a battery unit or the like (not shown). A shaft 131 is driven by an output gear 12 of the motor 11 via a gear 13 mounted thereon. A wheel 14 is eccentrically mounted on the shaft 131 and a ring 15 is securely mounted around the wheel 14.

The first piston 32 is connected to a seat 151 on the ring 15 via a pin 321, and the second piston 22 is connected to a second seat 152 via a connecting rod 23 and a pin 231, thereby allowing reciprocating motion of the pistons 32 and 22 in associated first and second cylinders 3 and 2.

Figure 4:
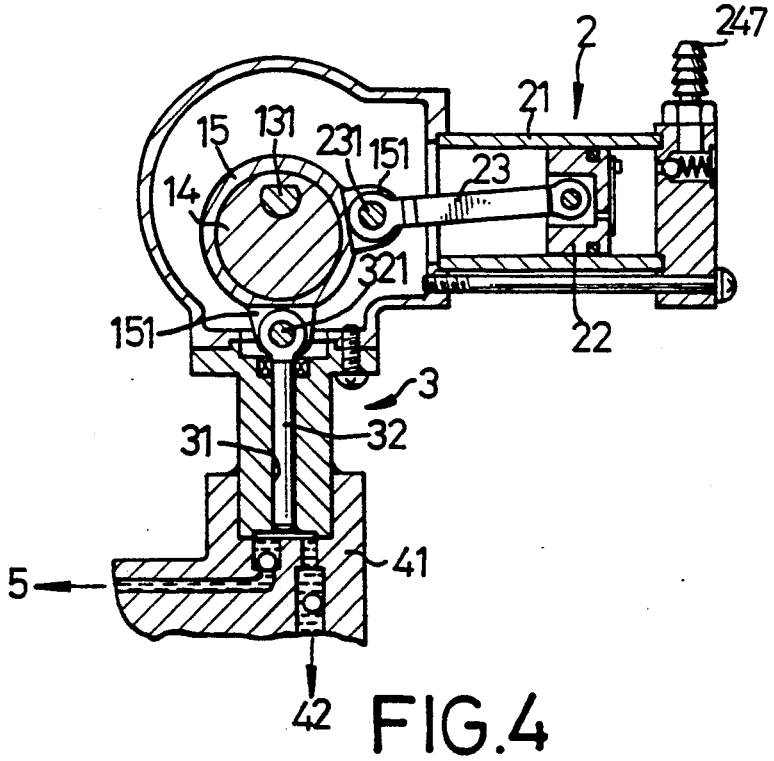
FIG. 4 is a cross-sectional view similar to FIG. 3, wherein the hydraulic jack is in a compression stroke.

Referring to FIGS. 3 and 4, in FIG. 3, the first piston 32 is in a suction stroke, and in FIG. 4, the first piston 32 is in a compression stroke, thereby providing a lifting function, which is too conventional to be further illustrated.

Figure 5:
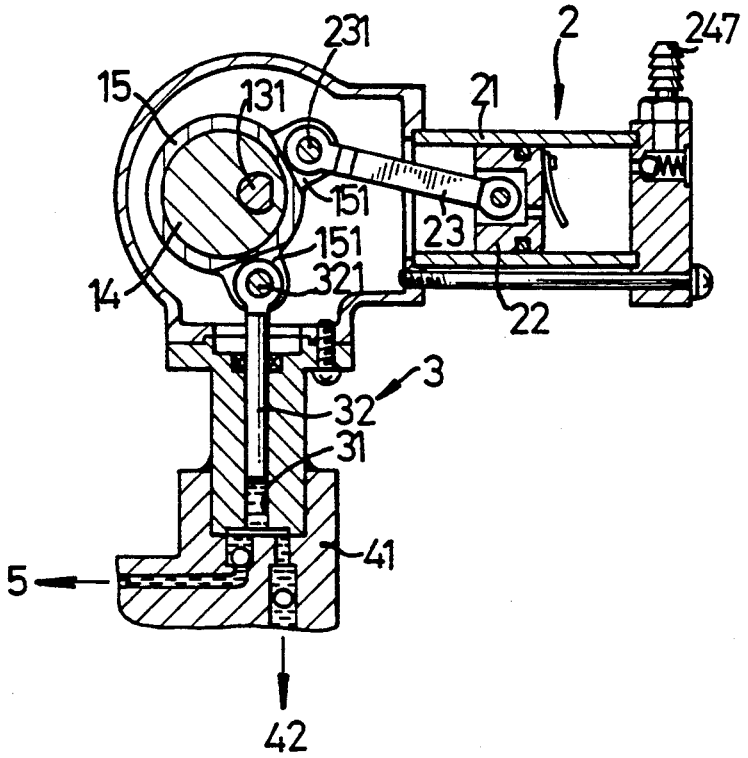
FIG. 5 is a cross-sectional view similar to FIG. 3, wherein the air pump is in a suction stroke.
Figure 6:
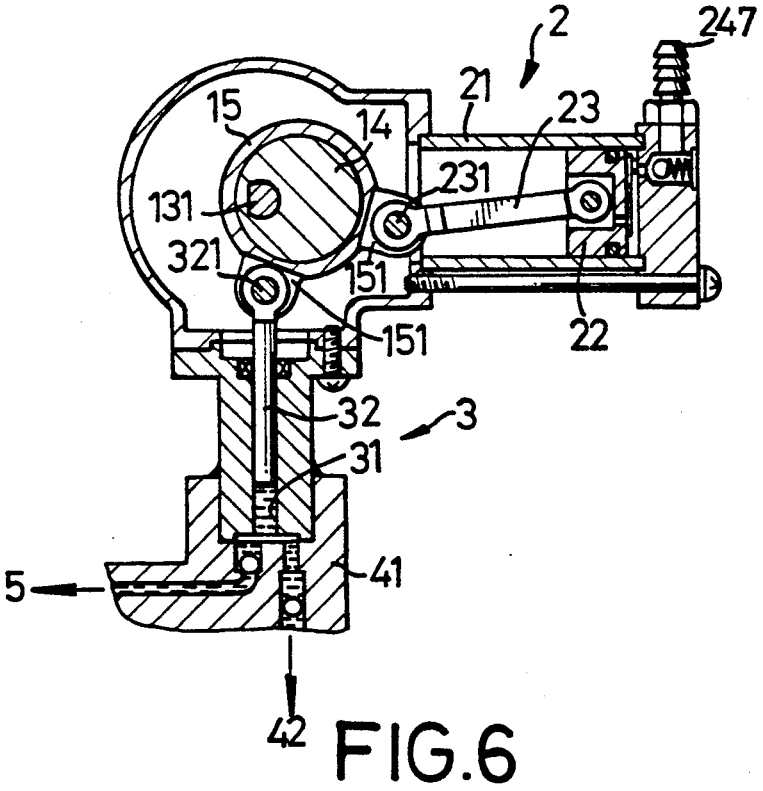
FIG. 6 is a cross-sectional view similar to FIG. 5, wherein the air pump is in a compression stroke.
Figure 7:
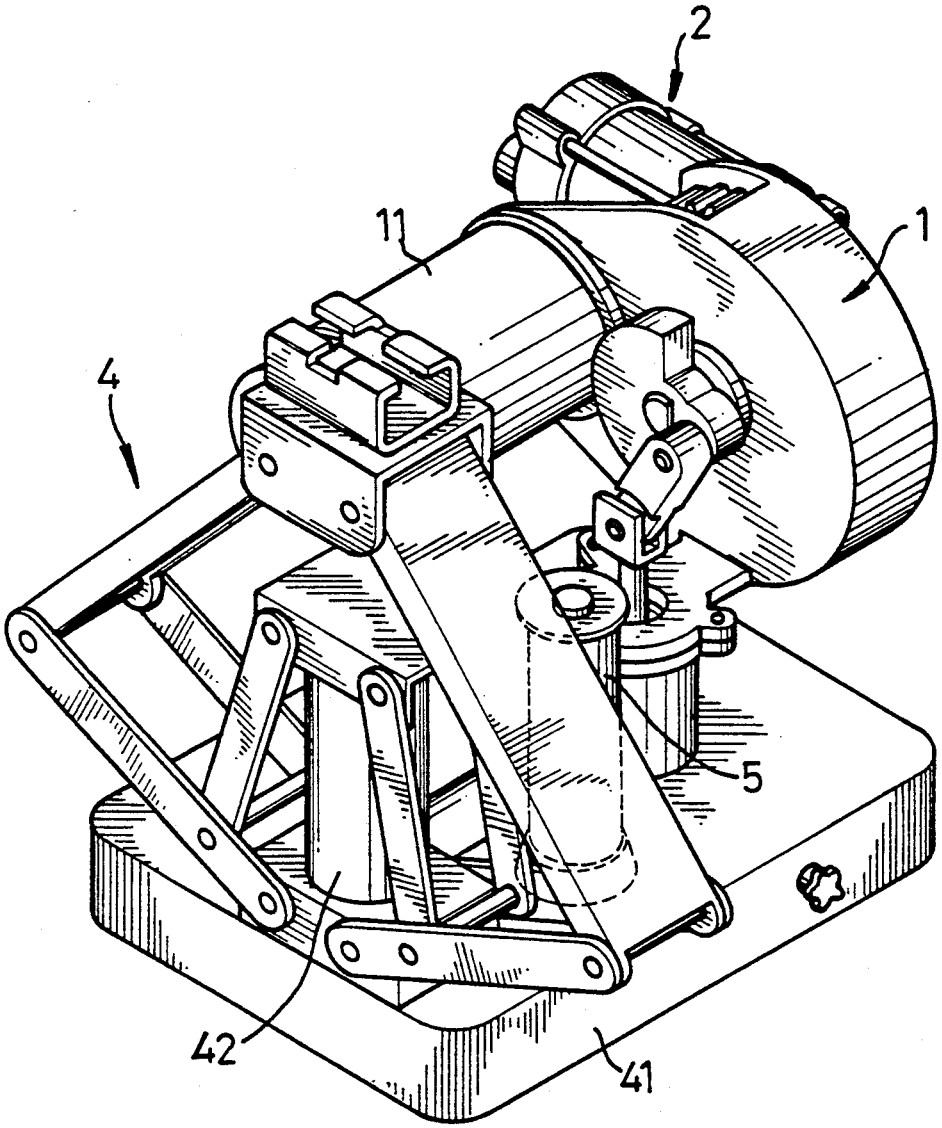
FIG. 7 is a perspective view of another embodiment of the electrical hydraulic jack/air pump in accordance with the present invention.
Figure 8:
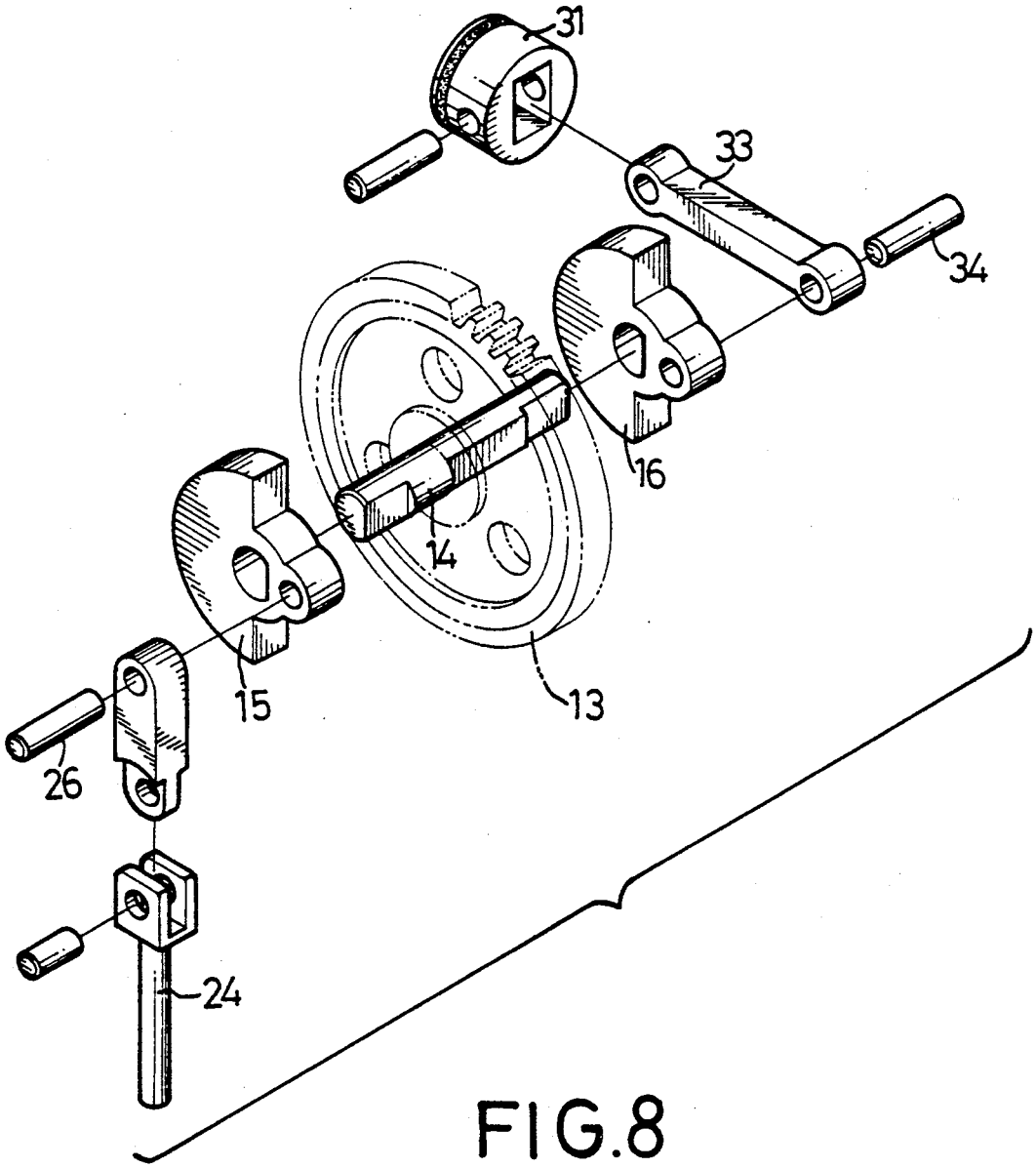
FIG. 8 is an exploded view of the electrical hydraulic jack/air pump in FIG. 7.
Figure 9:
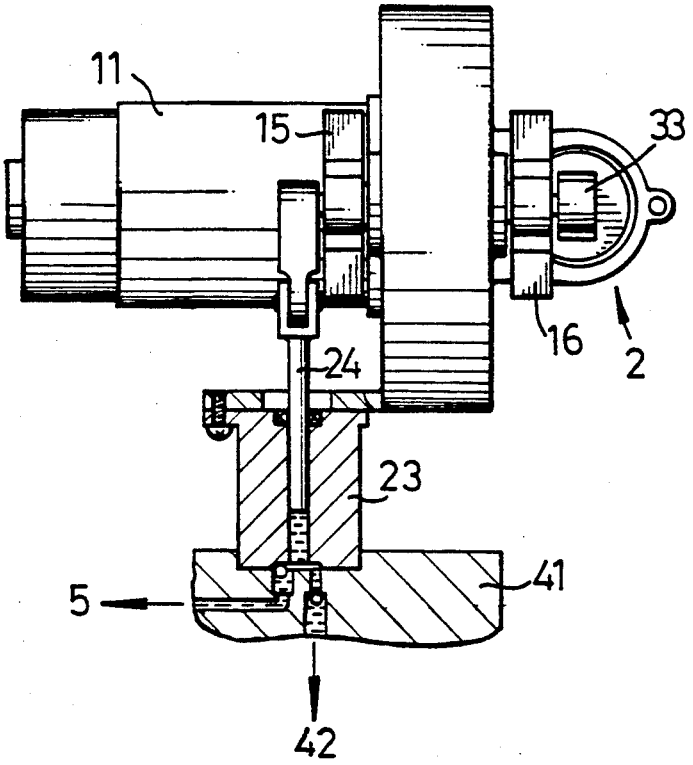
FIG. 9 is a partial cross-sectional view showing the structure of the transmission assembly.
Figure 10:
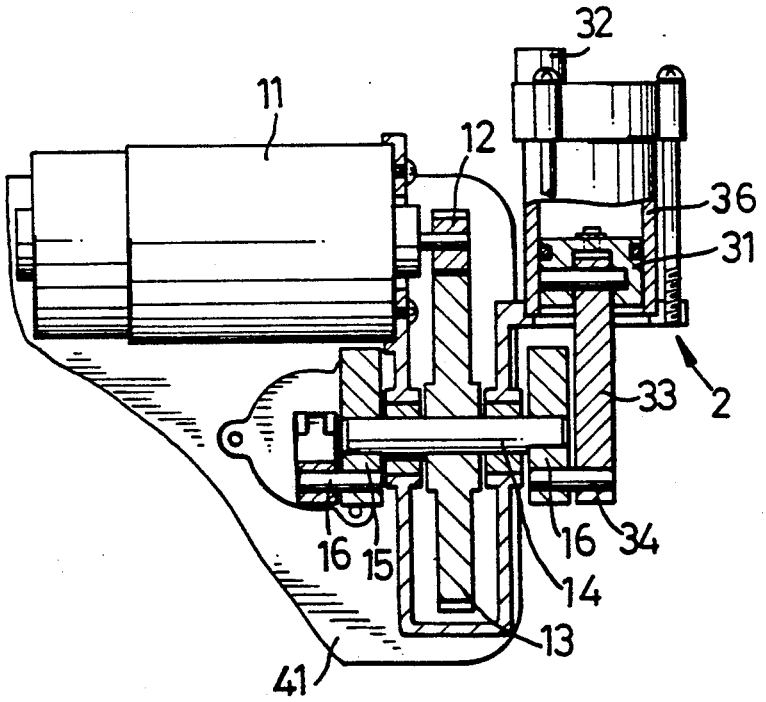
FIG. 10 is a partial cross-sectional view from the top showing the structure of the transmission assembly.

Referring to FIGS. 5 and 6, in FIG. 5, the second piston 22 is in a suction stroke, and in FIG. 6, the second piston 22 is in a compression stroke, thereby providing an air-filling function, which is also too conventional to be further illustrated.

It is appreciated that the hydraulic jack assembly and the air pump can operate simultaneously. Nevertheless, when only one of them is required, a corresponding release valve can be opened to release its function, which is also too conventional to be further illustrated.

FIGS. 7 through 10 show another embodiment of the present invention in which the base 41, the hydraulic jack assembly 4, and the air pump assembly 2 are the same as those of the above-illustrated embodiment. The transmission assembly of this embodiment also includes a motor 11 with an output gear 12 through which power is transmitted to a crankshaft 14 via a gear 13. First and second cranks 15 and 16 are mounted on the crankshaft 14. A first piston 24 for effecting the lifting function of the hydraulic jack assembly 4 is securely connected to the first crank 15 via a pin 26. A second piston 31 for effecting the air-filling function of the air pump assembly 2 is securely connected to the second crank 16 via a connecting rod 33 and a pin 34. A nozzle 32 is provided on the second piston 31 for outputting air. It is appreciated that operation of reciprocating motion of the first and second pistons 24 and 34 in associated cylinders 36 and 23 is conventional therefore further explanation is not required.

Although the invention has been explained in relation to its preferred embodiment, it is to be understood that many other possible modifications and variations can be made without departing from the spirit and scope of the invention as hereinafter claimed.

I claim:

1. An electrical hydraulic jack/air pump comprising:

a hydraulic jack assembly having a first cylinder for supplying fluid to a lifting cylinder for effecting a lifting function;

an air pump assembly having a second cylinder for effecting an air-filling function; and a transmission assembly comprising a driving means electrically connectable to a power source, a shaft driven by said driving means, a wheel eccentrically mounted on said shaft, a ring securely mounted around said wheel, and first and second pistons respectively mounted in said first and second cylinders, each said first and second piston respectively having an end pivotally connected to said ring, thereby providing reciprocating motion of said first and second pistons in their associated first and second cylinders responsive to rotation of said shaft for effecting said lifting and air-filling functions.

2. An electrical hydraulic jack/air pump comprising:

a hydraulic jack assembly having a first cylinder for supplying fluid to a lifting cylinder for effecting a lifting function;

an air pump assembly having a second cylinder for effecting an air-filling function; and a transmission assembly comprising a driving means electrically connectable to a power source, a crankshaft driven by said driving means with first and second cranks mounted thereon, and first and second pistons respectively mounted in said first and second cylinders, each said first and second piston having an end respectively pivotally connected to said first and second cranks, thereby providing reciprocating motion of said first and second pistons in their associated first and second cylinders responsive to rotation of said shaft for effecting said lifting and air-filling functions.

3. The electric hydraulic jack/air pump of claim 1 wherein release means is provided to release the function of one of said cylinders.

4. The electric hydraulic jack/air pump of claim 2 wherein release means is provided to release the function of one of said cylinders.

* * * * *